United States Patent [19]

Wenger et al.

[11] 4,241,777

[45] Dec. 30, 1980

[54] PORTABLE SHELL

[75] Inventors: Jerry A. Wenger, Owatonna; Herman A. Clausen, West Concord; David R. Boeddeker, Owatonna; Harvey M. Urch, West Concord, all of Minn.

[73] Assignee: Wenger Corporation, Owatonna, Minn.

[21] Appl. No.: 34,002

[22] Filed: Apr. 27, 1979

Related U.S. Application Data

[63] Continuation of Ser. No. 825,065, Aug. 16, 1977, abandoned.

[51] Int. Cl.[3] ..... A47G 5/00

[52] U.S. Cl. ..... 160/135

[58] Field of Search ..... 160/135, 351; 108/129, 108/131, 132, 133; 248/188, 188.6; 211/195

[56] References Cited

U.S. PATENT DOCUMENTS

| | | | |
|---|---|---|---|
| 2,701,745 | 2/1955 | Mackintosh | 108/133 |
| 3,180,446 | 4/1965 | Wenger | 160/351 |
| 3,232,370 | 2/1966 | Jaffe | 160/135 |
| 3,428,108 | 2/1969 | Singer | 160/351 |

*Primary Examiner*—Peter M. Caun

*Attorney, Agent, or Firm*—Wegner, Stellman, McCord, Wiles & Wood

[57] ABSTRACT

A portable shell of a lightweight construction usable as a room divider, display panel, or acoustical or visual enclosure detachably connectable to the framework for mounting in either a support position or a storage position. The leg structure includes a pair of legs each having a pivotally-mounted foot movable between an operative position or a storage position. Additionally, the shell has a canopy panel hinged to one end thereof for extending the height of the shell and the legs can be attached at different positions on the framework for providing different effective shell heights.

16 Claims, 14 Drawing Figures

Fig. 8.
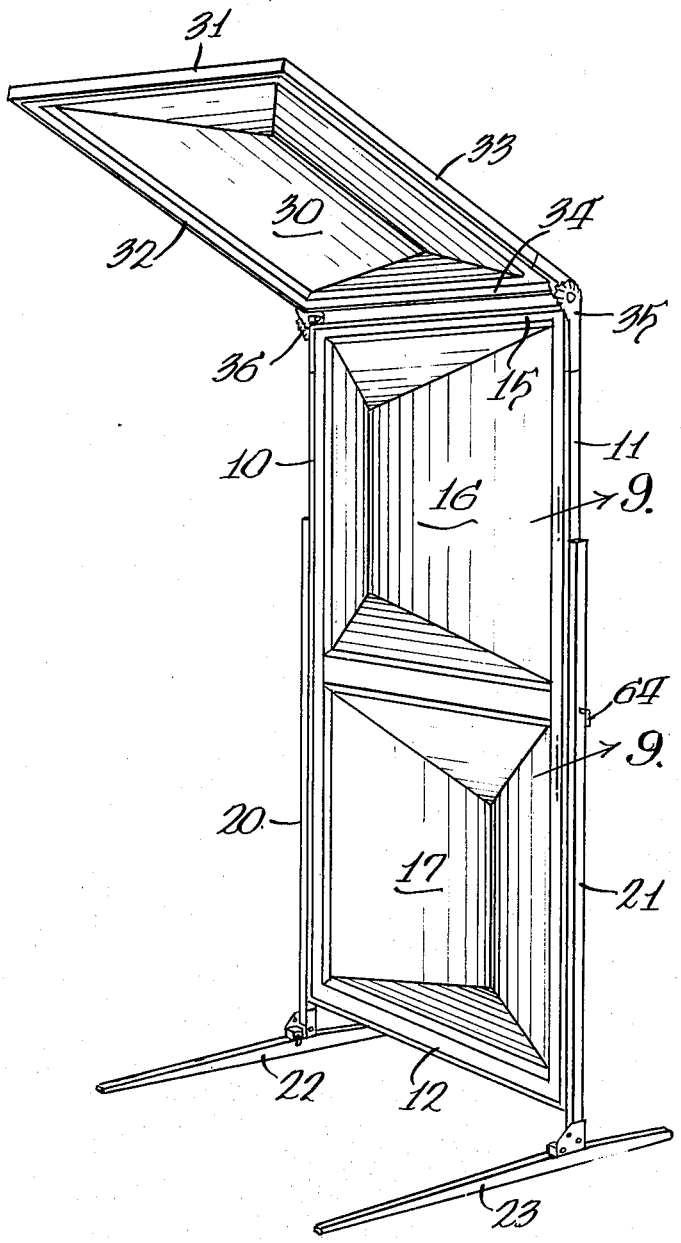
Fig. 11.
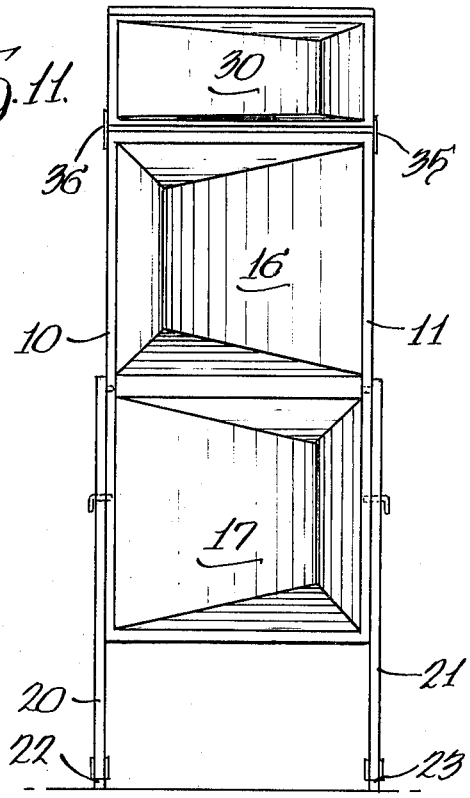
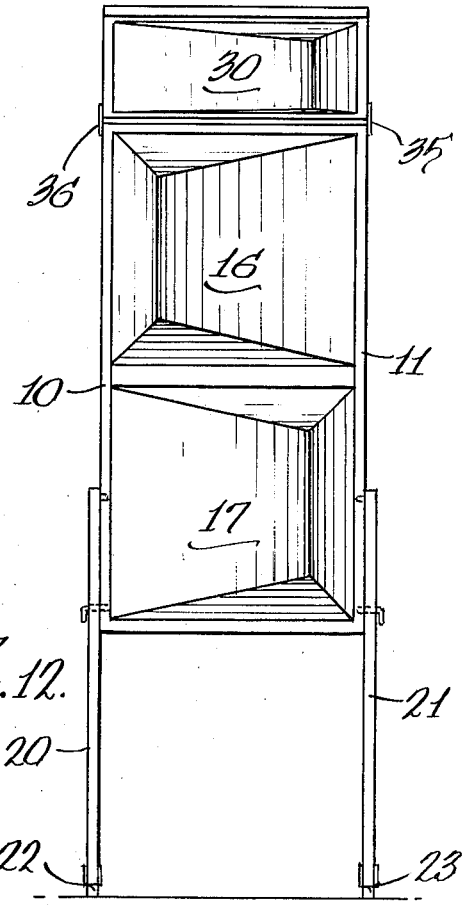
Fig. 12.

PORTABLE SHELL

This is a continuation of application Ser. No. 825,065 filed Aug. 16, 1977, now abandoned.

BACKGROUND OF THE INVENTION

This invention relates to portable shells usable as a room divider, display panel, or acoustical or visual enclosure and, in particular, to such shells usable with performing art groups such as choral or instrumental groups.

In the performing arts, it is quite common to use portable shells to control the direction and reflect sound created by orchestras, smaller musical ensembles, or vocal groups. Use of such a portable shell enables transport of the shells and grouping thereof, dependent upon the total reflecting surface required. A need has developed for a lightweight, low-cost portable shell structure to provide the desired reflection of the sound produced by a performing group wherein the portable shells may be easily stacked when not in use in a minimum size area and easily transported and erected for use.

The prior art includes H. J. Wenger U.S. Pat. No. 3,180,446 and J. A. Wenger et al U.S. Pat. No. 3,630,309 which disclose portable shell structures, but which do not have the lightweight, storage, transport and set-up features of the portable shell disclosed herein.

SUMMARY OF THE INVENTION

The present invention relates to a portable shell of an improved construction providing additional highly desirable features over and above those found in the structures of the prior art.

A primary feature of the invention is to provide a lightweight portable shell having improved set-up, storage, and transport features and with greater versatility in the use thereof.

Another feature of the invention is to provide a portable shell having a framework with panel means and leg structure with the leg structure being connectable to the framework at several different locations to provide different operative elevations for the shell.

Another feature of the invention is to provide a portable shell, as referred to the preceding paragraph, wherein the leg structure is completely separable from the framework and may be related thereto in a storage position whereby the leg structure, including pivotally mounted feet, is disposed adjacent the framework to not require any additional space in storage or transport of the shells in a stacked relation.

In carrying out the foregoing, the framework of the portable shell has a pair of side frame members each with a series of openings along the length thereof and the legs of the leg structure have mounting structure coacting with a pair of openings in each side frame member. Any two of the series of openings are selected to provide for attachment of the legs to the framework at different locations for different elevations of the shell in use and with certain of said openings also being usable to attach the legs thereto when the legs are in a reversed position to have the legs and pivotally-mounted feet extend along the side frame members to facilitate stacking of plural shells in nested relation. As part of the foregoing, the portable shell may have a hinged canopy panel at the upper end thereof, with this canopy panel being movable between a storage position adjacent the framework and an elevated operative position whereby in the storage position the canopy panel nests within the perimeter of the shell.

BRIEF DESCRIPTION OF THE DRAWINGS

FIG. 8 is a perspective view of the portable shell shown in one of the erected operative positions wherein the shell is at the lowest of three elevations;

FIG. 11 is a front elevational view of the portable shell shown in an erected operative position at an intermediate elevation;

FIG. 12 is a view, similar to FIG. 11, showing the portable shell in the erected operative position at a higher elevation;

DESCRIPTION OF THE PREFERRED EMBODIMENT

Figure 1:
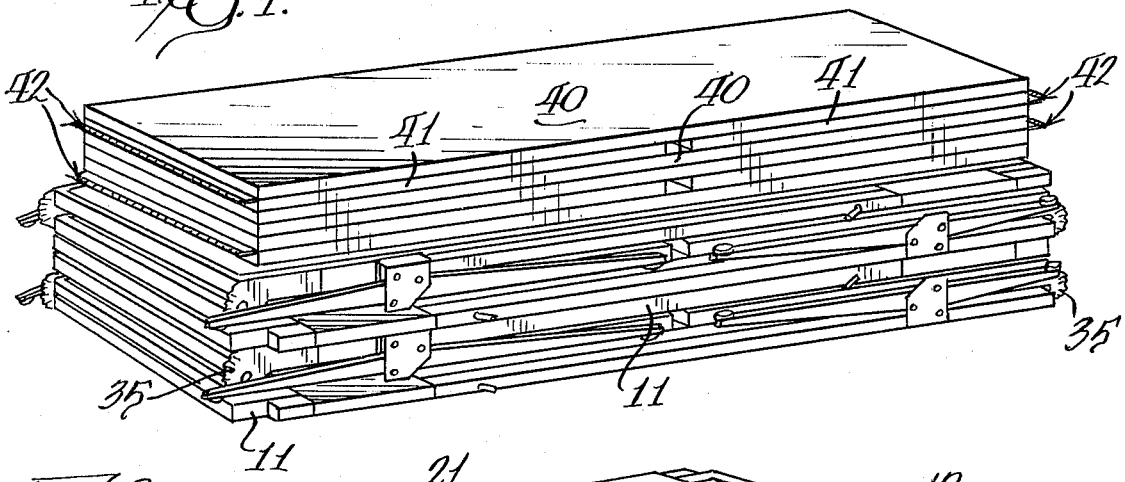
FIG. 1 is a perspective view showing a series of portable shells in stacked, nested relation for storage and with associated filler panels in the upper part of the stack.

The lightweight, portable shell is shown erected in one operative position in its lowest elevation in FIG. 8 wherein a framework with interconnected frame members including a pair of side frame members 10 and 11, a bottom frame member 12, and a top frame member 15 defines a generally rectangular area and carries one-piece panel means defining a pair of panels 16 and 17 which may be of an acoustical nature defining acoustical panel means for reflecting sound. The framework is supported in operative position by a leg structure including a pair of legs 20 and 21 of square tubular stock associated with the side frame members 10 and 11, respectively, and with each leg having a foot 22 and 23, respectively, pivoted intermediate its ends to the lower end of the associated leg.

An additional panel, forming a canopy panel 30, is carried in a framework having interconnected frame members 31, 32, 33, and 34 and is pivotally connected to the upper end of the framework by a pair of hinge means 35 and 36 connected between the side frame members 10 and 11 and the frame members 32 and 33 of the canopy panel. The hinge means each has a pair of hinge members interconnected by a pin and with suitable spring-loaded detent structure for holding the canopy panel in a desired position, including a storage position, shown in FIGS. 1 to 4 and an elevated position at an incline to the vertical, as shown in FIG. 8, or other operative positions selectable by manual rotataive positioning of the canopy panel.

An intermediate operative position for the shell is shown in FIG. 11 wherein the framework and panels 16 and 17 are at a greater distance from a floor than the arrangement shown in FIG. 8. The positioning of the portable shell in an operative position at an even higher elevation is shown in FIG. 12. In any of these arrangements, a plurality of shells may be nested for storage while in erected position.

Figure 13:
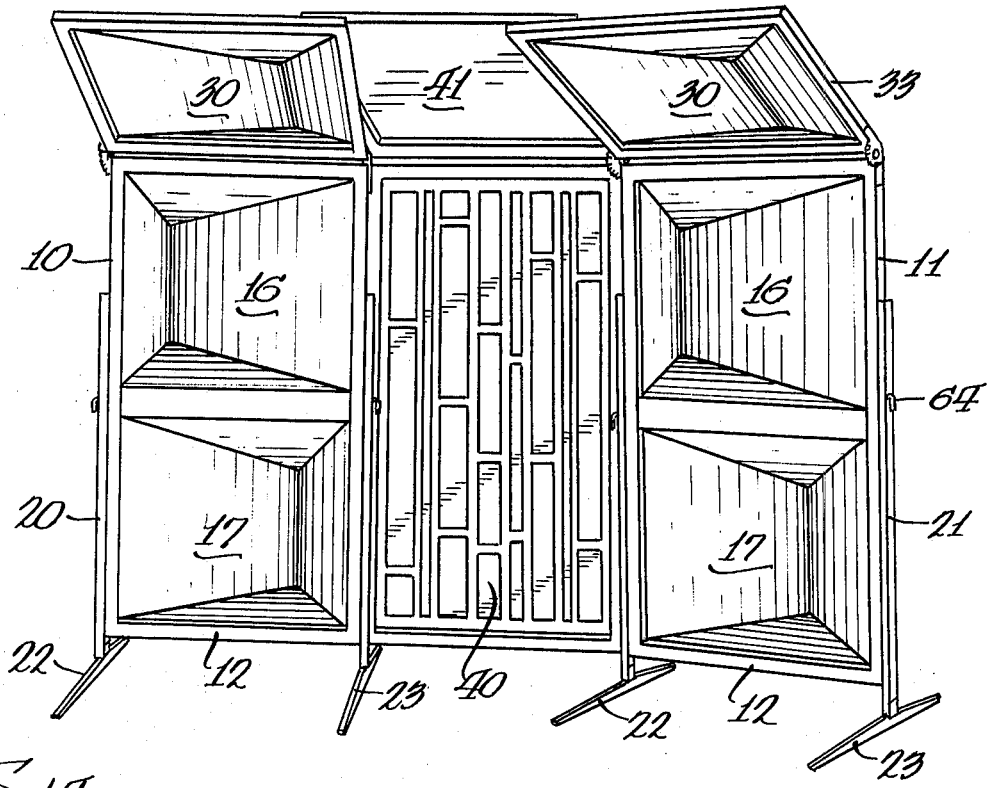
FIG. 13 is a perspective view, looking generally toward the front of a shell system, showing a pair of portable shells in operative position and associated with a filler panel.
Figure 14:
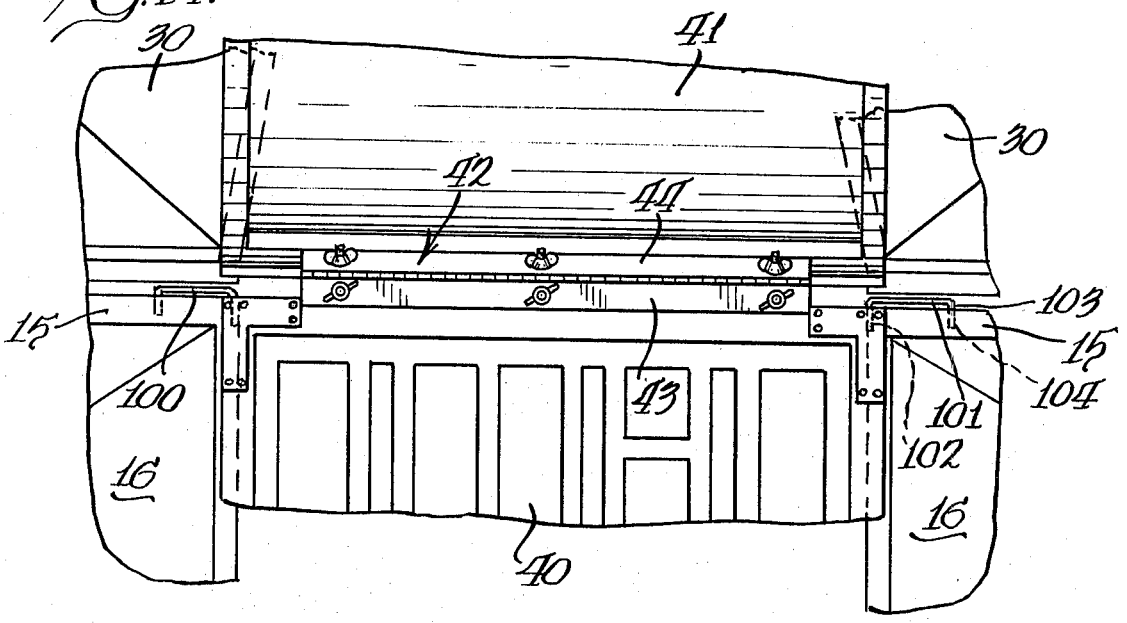
FIG. 14 is a fragmentary view, looking toward the rear of the system shown in FIG. 13.

The utilization of a pair of the portable shells with an associated filler panel is shown in FIG. 13. As shown, two of the shells having the operative position shown in FIG. 8 are placed in spaced-apart relation and may be at an angle to each other, as indicated by the direction of the feet 22 and 23. A filler panel 40 having a height equal to the framework of the portable shell is disposed to the rear thereof and has a canopy panel 41 resting on the back side of the canopy panels 30. Referring to FIG. 14, a piano-type hinge, indicated generally at 42, has the leaves 43 and 44 thereof secured to the upper edge of the filler panel 40 and the lower edge of the canopy panel 41, respectively.

A stack of four portable shells in nested relation with four filler panels 40 and associated canopy panels 41 on top thereof is shown in FIG. 1. The lowermost portable shell faces upward and has its canopy panel 30 folded in a storage position extending parallel and in abutting relation to the framework and thereabove and extending from the lowermost hinge 35 toward the left, as viewed in FIG. 1. The superimposed portable shell is faced downward and reversed, with its canopy panel 30 in storage position therebeneath to lie in the same plane as the canopy panel of the first-mentioned portable shell. This pattern is then repeated for the two additional portable shells thereabove.

Figure 2:
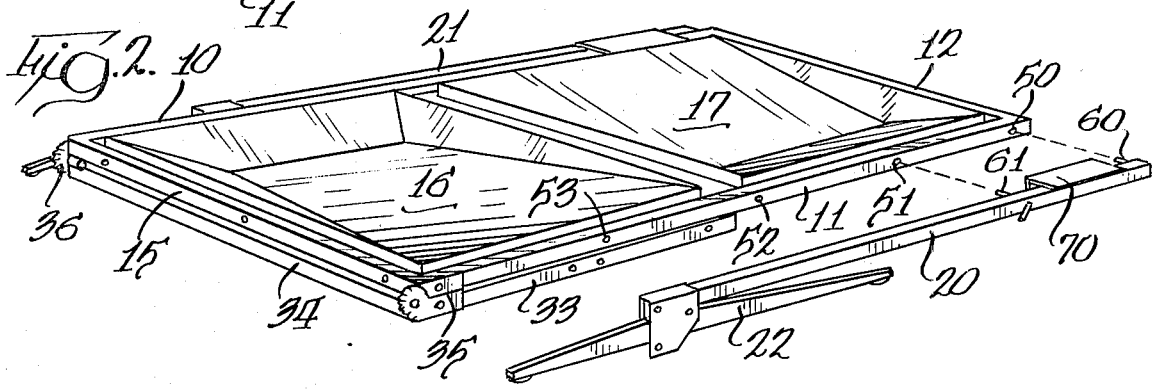
FIG. 2 is a perspective view looking toward the rear of a single horizontally-disposed portable shell showing the parts in storage position and with one of the legs of the leg structure separated therefrom.
Figure 3:
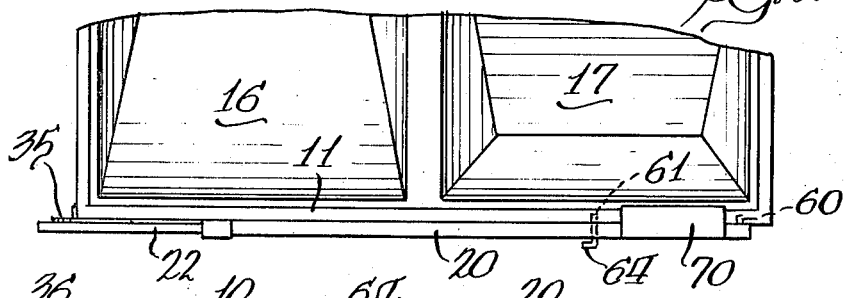
FIG. 3 is a fragmentary plan view, looking toward the rear of a horizontally-disposed portable shell showing a leg associated therewith in storage position.
Figure 4:
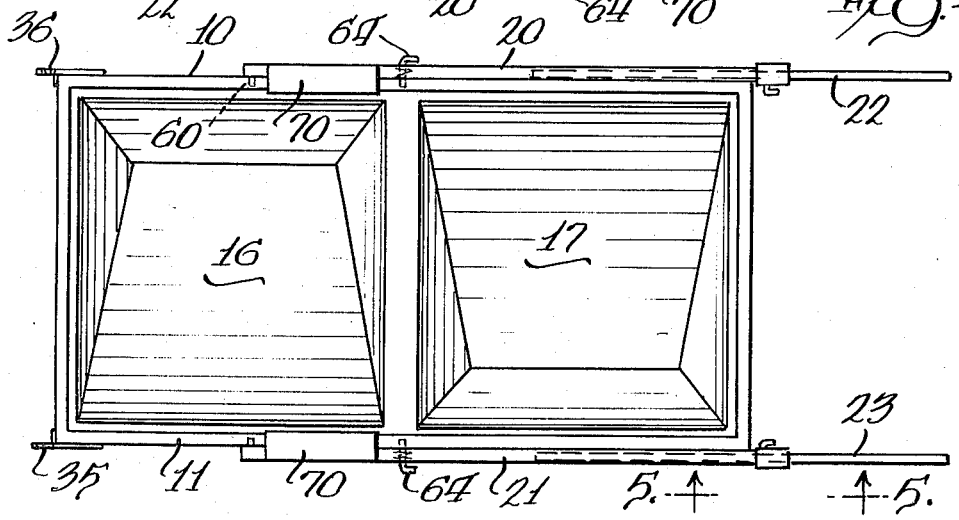
FIG. 4 is a plan view, looking toward the rear of a horizontally-disposed portable shell showing the legs associated therewith in operative position prior to the shell being erected to the operative position shown in FIG. 8.

The portable shell structure shown particularly in FIGS. 2 and 3 is for the portable shell next to the bottom in the stack of FIG. 1, however, it will be understood that all of the portable shells are of the same construction. The leg 20 is associated with the side frame member 11 when in the storage position and the leg 21 is associated with the side frame member 10. In erecting the portable shell, the leg 20 is removed from side frame member 11, as indicated in FIG. 2, and the leg 21 is similarly removed from the side frame member 10 and then the relation of the legs to the side frame members is reversed to form the operative position for the shell, as noted in FIG. 8, wherein the leg 21 is associated with the side frame member 11 and the leg 20 is associated with the side frame member 10 (FIG. 4).

Figure 9:
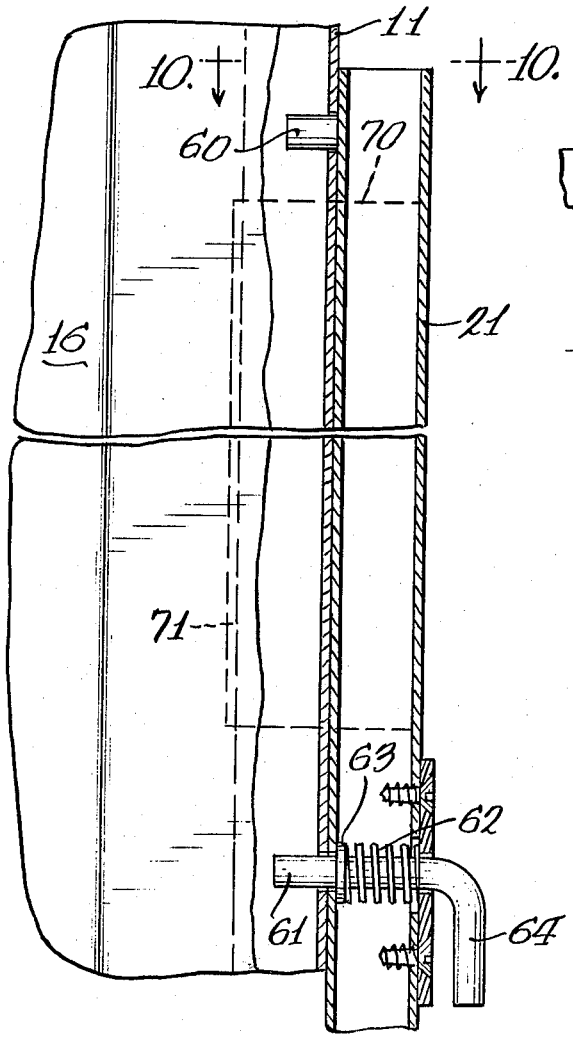
FIG. 9 is a fragmentary vertical section, taken generally along the line 9—9 in FIG. 8.

The structure for associating the legs with the framework includes a series of equally spaced-apart openings in each of the side frame members 10 and 11, with these openings being identified at 50–53 with respect to the side frame member 11 in FIG. 2. An additional opening (not shown) similar to opening 50 is used for connection of the hinge means 35 and 36 to the side frame members. The side frame member 10 has the same series of equally-spaced openings as the side frame member 11 and in alignment therewith. The structure additionally includes a fixed pin 60 (FIG. 9) extending laterally from the upper end of each of the legs 20 and 21. Additionally, each leg has an L-shaped latch pin 61 with an end projectable outwardly from the leg by a spring 62 positioned within the tubular leg and coacting between a wall thereof and a roll-pin 63 affixed to the latch pin. The latch pin has a handle end 64 to facilitate retraction of the latch pin from the position shown in FIG. 9. The fixed pin 60 and the latch pin 61 are spaced apart a distance equal to the distance between any two adjacent openings of the series of openings 50–53 whereby the pins may extend into any two adjacent ones of said openings.

An additional part of the attachment structure for connecting a leg to the framework includes an elongate bracket 70 secured to each of the legs in a position between the fixed pin 60 and latch pin 61 and having a flange 71 which, together with a wall 72 (FIG. 10) of the tubular leg, forms a U-shaped channel to receive and closely fit the tubular square section side frame member of the framework.

Figure 10:
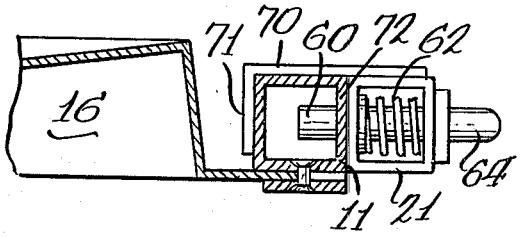
FIG. 10 is a plan view, partly in section, taken generally along the line 10—10 in FIG. 9.

Referring to FIG. 2, the positioning of the leg in storage position is accomplished by lifting the end of the leg 20 carrying the foot 22 to have the flange 71 of the bracket 70 clear the side frame member 11. The leg 20 is then advanced toward the side frame member to insert the fixed pin 60 in the opening 50. This also aligns the side frame member 11 with the U-shape channel provided by the bracket 70 and the leg may be lowered to bring the parts to a relation as shown in FIG. 10 and bring the latch pin 61 (in retracted position) into alignment with the opening 51. After the alignment occurs, the handle 64 is released and the spring 62 causes the latch pin 61 to move into the opening 51. This firmly locks the leg member 20 to the side frame member 11.

As stated previously, the arrangement of the legs in association with the side frame members is reversed between storage and operative positions thereof. Assuming that a portable shell is to be erected into operative position and referring to the shell of FIG. 2, each of the legs 20 and 21 is released from the associated side member by retraction of the latch pins 61 to permit upward pivoting of the legs to cause the bracket flanges 71 to clear the side frame members and then the fixed pins 60 are withdrawn from the openings 50. The relation of the legs is then reversed to the position shown in FIG. 4 wherein, with the framework still resting on a floor surface, the leg 20 is associated with the side frame member 10 by first inserting the fixed pin 60 with the leg tilted and the leg is then lowered to bring the bracket 70 into fitting relation with the side frame member followed by insertion of the latch pin 61. A similar action occurs with respect to the leg 21 in association with the side frame member 11.

In the relation of FIG. 4, the fixed pins 60 have been positioned in the openings 53 of the side frame members and the movable latch pins 61 have been positioned in the openings 52 of the side frame members. This ultimately results in an elevation for the shell shown in FIG. 8. If it were desired to have the shell at an intermediate elevation, as shown in FIG. 11, the fixed pins 60 would be inserted in the side frame openings 52 and the movable pins would be inserted in the side frame opening 51. If a higher elevation is desired, the fixed pin 60 would be inserted in the side frame opening 51 and the movable latch pin 61 would be inserted in the side frame opening 50.

Subsequent to making the desired association of legs to side frame members as described in the preceding paragraph, the framework is raised and the feet 22 and 23 associated with the legs are moved from the storage position to an operative position. In the storage position, as noted particularly in FIGS. 1 and 2, the feet extend generally parallel to the associated side frame member and are moved to a position generally normal to a leg. The storage position is shown particularly in FIG. 5 and the operative position is shown in FIG. 6.

Figure 5:
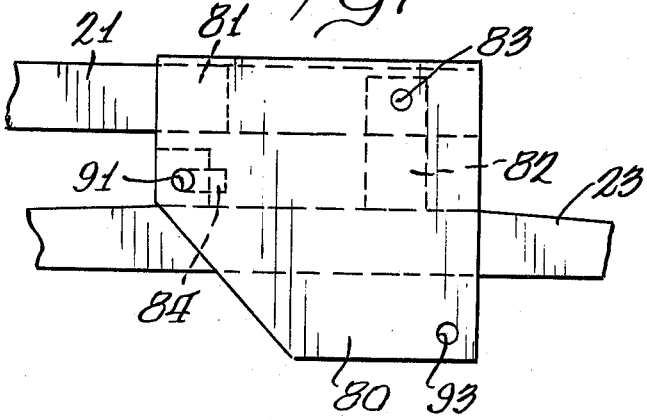
FIG. 5 is a fragmentary view of a leg and associated foot, taken generally along the line 5—5 in FIG. 4.
Figure 6:
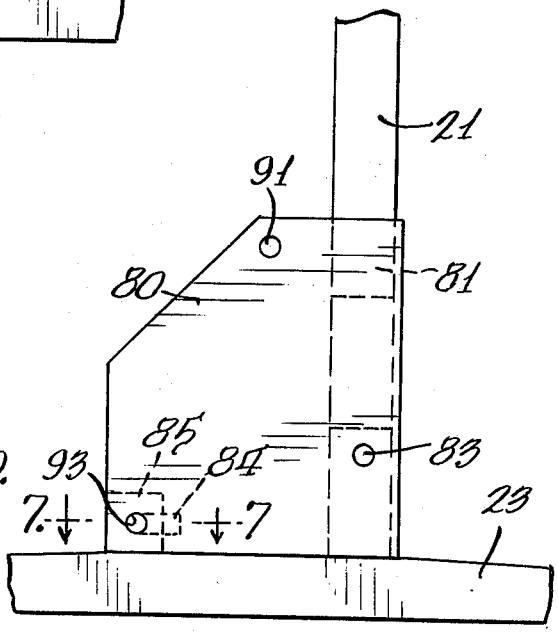
FIG. 6 is a view, similar to FIG. 5, showing the leg and foot in operative relation.
Figure 7:
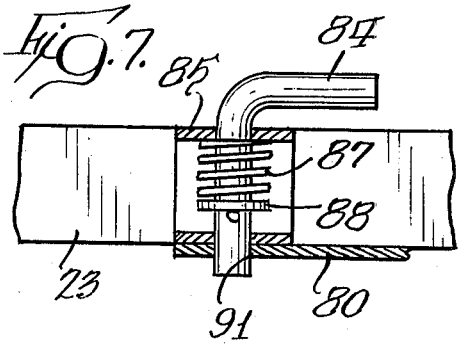
FIG. 7 is a fragmentary section, taken generally along the line 7—7, showing the latch structure coacting between a foot and leg.

The feet are pivotally connected to the legs by structure illustrated with respect to leg 21 and foot 23 and shown particularly in FIGS. 5–7. The lower end of the leg 21 has a plate 80 secured, as by welding, to opposite sides of a lower end 81 of the leg. A tubular post 82 secured to the foot 23 is connected by a pivot pin 83 to the plate 80. A latch member, indicated generally at 84, is movably mounted in a tubular post 85 attached to the foot 23. The latch member 84 is urged to the position shown in FIG. 7 by a spring 87, acting between the post 85 and a roll-pin 88 secured to the latch member. The latch member 84 is cooperable with either of two openings formed in the plate 80. In the storage position of the foot, the latch member coacts with an opening 91 in the plate while, in the operative position, the latch member coacts with an opening 93 in the plate 80.

With the structure described herein, it is possible to stack a series of portable shells in an area substantially no larger than the area of a basic framework of the shell, with the reversal of the legs from the normal operative position and the movement of the foot associated with each leg to the storage position shown in FIG. 2. The stack is of a size to be transported in a standard size station wagon.

A portable shell may be erected from storage position in the manner described previously and with the initial assembly position being in relation to selected ones of the series of openings 50–53, to provide the desired elevation for the shell in use. After erection of the shell with the feet in operative position, the canopy panel 30 may then be moved manually to a desired angle relative to the panels 16 and 17. Alternatively, the canopy panel 30 can be positioned before upright positioning of the shell.

If two or more portable shells are to be used at an elevation selected from the various elevations shown in FIGS. 8, 11 and 12, the shells may be related as shown in FIG. 13 and then the filler panel 40 may be used to fill the space between adjacent portable shells.

The filler panel 40 is easily associated with adjacent portable shells by means of a pair of hooks 100 and 101, each having a leg 102 thereof pivotally mounted at the upper corner of the filler panel and another leg 103 thereof extending outwardly beyond the filler panel for engagement within an opening 104 formed in the top frame member 15 of the portable shell. The swivel action of the hooks 100 and 101 permits easy positioning of the filler panel 40 to the rear of adjacent shells and location of the hook ends 103 in the openings 104 for supporting the lightweight filler panel from the adjacent portable shells, even with the portable shells at different angles and with varying gaps between shells. As an initial step, the canopy panel 41 is moved upwardly from a position to the rear of the filler panel by means of the hinge 42 and engages and is supported by the back side of the canopy panels 30 of the adjacent portable shells and is free to move as the hooks are attached.

With the structure disclosed herein, the shells may be easily erected for use at different elevations and stored in either a stacked storage position or an erected position and with there being no loose parts that could be lost.

We claim:

1. A lightweight portable shell comprising:

a framework with panel means supported by frame members including a pair of spaced-apart side frame members;

a supporting leg structure including a pair of legs and each having a foot at an end thereof; and means for detachably locking said legs (a) one to each side frame member at any one of several different operative positions along the length of the side frame member to extend from the side frame member selectively different amounts dependent on the desired height of the shell, and (b) one to each side frame member opposite the one to which the leg is secured in the operative position to be in side-by-side substantially coextensive storage positions therewith, said locking means comprising means for preventing separation of the framework from the legs notwithstanding lifting of the assembled shell structure in any direction.

2. A portable shell as defined in claim 1 wherein said detachable locking means includes a series of openings in each side frame member, a fixed pin on a leg member engageable in one of said openings, a movable latch pin on a leg member spaced from the fixed pin to engage in another of said openings, means for holding the leg to a side frame member, and there being at least three equally spaced openings in each side frame member whereby the leg may be locked at different locations to provide selectively different heights for the shell and retention of the leg in said storage position.

3. The portable shell of claim 1 wherein said locking means comprises a pair of openings in each side frame member, a fixed pin and a movable latch pin spaced apart a distance equal to the distance between a pair of openings and insertable in said openings and channel means to engage the exterior of a side frame member, said openings being operable to receive a fixed pin and a latch pin of one leg for the lowest elevation of the shell and to receive the fixed pin and latch pin of the other leg when said legs are to be in said storage position.

4. A lightweight portable shell having a framework with panel means supported by frame members including spaced-apart side frame members, a separable supporting leg structure including a pair of legs and each having a foot at an end thereof, and means for detachably locking said legs one to each side frame member at any one of several different positions along the length of the side frame member dependent on the desired height of the shell, said means for detachably locking a leg to a side frame member including a series of spaced-apart openings in the side frame member, a pivot pin on the leg selectively engageable in one of said openings, a retractable latch pin adjustably carried on the leg to be selectively engageable in another of said openings, and wall means on said leg having a first portion engageable with the said frame member to limit pivotal movement of the leg in one direction about the pivot pin engaged with a side frame member opening to a position wherein said latch pin is aligned with said another opening, and a second portion engageable with the side frame member for preventing movement of the leg away from the side frame member when the leg is arranged with said pins engaging the side frame member in said openings.

5. A portable shell as defined in claim 4 wherein said side frame is of square tubular stock and said wall means comprises a bracket in association with said leg, said bracket defining with said leg a U-shaped channel arranged to fit on said side frame member.

6. A portable shell as defined in claim 4 wherein said openings are related to said fixed pin and latch pin to enable reversal of a leg and attachment to a side frame member in a storage position.

7. A portable shell having a framework with a pair of side frame members and acoustical panel means, a canopy panel associated with said framework, hinge means mounting said canopy panel at an end of the framework for movement between an operative position inclined relative to said framework and a storage position parallel to and abutting the framework, leg structure including a pair of legs, each of said legs having a foot pivotally connected intermediate its ends to a leg for movement between a parallel storage position and an operative position normal to the leg, and means for locking a leg to one side frame member in use of the shell and for locking said last-mentioned leg to the other side frame member for storage with said foot disposed within the length of the framework and adjacent a canopy panel in storage position whereby plural shells may be stacked in an area substantially no larger than the area of the framework.

8. A portable shell as defined in claim 7 wherein said framework has a top frame member with an opening adjacent each end thereof, a filler panel positionable behind a pair of said shells to fill the space therebetween, a pair of hooks at opposite edges of said filler panel and each having a first leg pivoted to said filler panel to permit swivel action of the hooks, said hooks each having a second leg to fit in one of the top frame member openings in an adjacent shell whereby the spacing between adjacent shells may be varied, and said filler panel having a canopy panel hinged along the top thereof and supportable against the back of the canopy panels of adjacent shells.

9. A supporting leg structure including an elongate tubular member, a fixed pin adjacent an end thereof and extending outwardly therefrom, a retractable latch pin spaced from the fixed pin and extending from the tubular member in the same direction as the fixed pin, a bracket secured to the tubular member intermediate said pins and with the tubular member defining a U-shaped channel to receive a part of a device to be supported, a foot pivoted intermediate its ends to an end of said leg for movement between storage and operative positions, and latch means for holding said foot in either one of said positions.

10. A leg structure as defined in claim 9 wherein said latch means includes a latch member, and a plate affixed to said leg with openings to coact with said latch member to hold the foot in either of said positions.

11. A portable shell comprising a framework having a top and a bottom and with a pair of side frame members and acoustical panel means, leg structure including a pair of legs, each of said legs having a foot pivotally connected intermediate its ends to a leg for movement between a parallel storage position and an operative position normal to the leg, and means for locking a leg to one side frame member in use of the shell with the foot beyond the bottom of the framework and for locking said lastmentioned leg to the other side frame member for storage with said foot disposed within the length of the framework whereby plural shells may be stacked in an area substantially no larger than the area of the framework.

12. A portable shell comprising a framework having a top and bottom and with panel means supported by frame members including spaced-apart first and second side frame members, a separable supporting leg structure including first and second legs and each having a foot member pivotally mounted at an end thereof, and means including a pair of pin-receiving openings in each side frame member for detachably locking the first and second legs to the first and second side frame members respectively, to support the shell in operative position with said foot members extending beyond said bottom and for detachably locking the first and second legs to the second and first side frame members respectively, to place the legs in storage position with said foot members near said top of the framework.

13. A portable shell system having plural acoustical shells each with a framework having panel means, said frameworks each including a top frame member with an opening adjacent an end thereof, a filler panel positionable between adjacent shells to fill the space therebetween, and means for adjustably mounting the filler panel to said adjacent shells including a pair of hooks at opposite edges of said filler panel and each having a first leg pivoted to an upper corner of the filler panel to permit swivel action of the hooks, said hooks each having a second leg extending beyond the filler panel to fit in one of the top frame member openings in an adjacent shell whereby the spacing between adjacent shells may be varied with the space therebetween filled by said filler panel.

14. A portable shell system as defined in claim 13 wherein each of said shells has a canopy panel hinged to the upper end thereof, and said filler panel having a canopy panel hinged along the top thereof and supportable against the back of the canopy panels of adjacent shells.

15. A lightweight portable shell or the like comprising, a framework with panel means supported by frame members including two spaced-apart side frame members, a separable supporting leg structure including a pair of legs and each having a pivotally-mounted foot at an end thereof movable between a storage position parallel to a side frame member and an operative position generally normal to a side frame member, means for locking said foot in either of said positions including a retractable latch member, and means for detachably locking a leg to one side frame member in use of the shell with the foot at a distance from the framework and for locking said leg to the other side frame member for storage and with the leg reversed to have the associated foot disposed within the length of the side frame member including a pair of openings spaced along the length of each side frame member, a fixed pin on each leg and extending outwardly therefrom, a retractable latch pin on each leg spaced from the fixed pin and extending in the same direction, a bracket secured to each leg and with the leg defining a channel to receive a length of the side frame member whereby in attachment of a leg to a side frame member in either storage or operative positions the leg is inclined relative thereto to insert the fixed pin in one of said openings and the leg is then pivoted into alignment with the side frame member, while the retractable pin is retracted, to interengage the channel with the side frame member followed by release of the retractable latch pin for movement into the second of said openings.

16. A lightweight portable shell or the like comprising, a framework with panel means supported by frame members including two spaced-apart side frame members each being formed of generally square tubular stock, a separable supporting leg structure including a pair of legs and each having a pivotally-mounted foot at an end thereof movable between a storage position parallel to a side frame member and an operative position generally normal to a side frame member and beyond said framework, means for locking said foot in either of said positions including a retractable latch member, and means for detachably locking a leg to one side frame member at any one of a plurality of different heights in use of the shell and for locking said leg to the other side frame member for storage and with the leg reversed to have the associated foot disposed within the length of the side frame member including at least three openings equally spaced along the length of each side frame member, a fixed pin on each leg and extending outwardly therefrom, a retractable latch pin on each leg spaced from the fixed pin a distance equal to the spacing between a pair of said openings and extending in the same direction, a bracket secured to each leg intermediate said pins and with the leg defining a U-shaped channel to receive a length of the square tubular stock of a side frame member whereby in attachment of a leg to a side frame member in either storage or operative positions the leg is inclined relative thereto to insert the fixed pin in one of said openings and the leg is then pivoted into alignment with the side frame member, while the retractable pin is retracted, to interengage the channel with the side frame member followed by release of the retractable latch pin for movement into a second of said openings.

* * * * *